US008886075B2

(12) United States Patent
Shinoya et al.

(10) Patent No.: US 8,886,075 B2
(45) Date of Patent: Nov. 11, 2014

(54) SPACING CONFIGURATION FOR A PROCESS CARTRIDGE AND AN IMAGE FORMING APPARATUS

(75) Inventors: Shota Shinoya, Nagoya (JP); Motoaki Mushika, Hashima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 297 days.

(21) Appl. No.: 13/429,506

(22) Filed: Mar. 26, 2012

(65) Prior Publication Data

US 2013/0051844 A1 Feb. 28, 2013

(30) Foreign Application Priority Data

Aug. 30, 2011 (JP) ..... 2011-186885

(51) Int. Cl.
*G03G 15/00* (2006.01)
*G03G 21/18* (2006.01)

(52) U.S. Cl.
CPC ..... *G03G 21/186* (2013.01)
USPC ..... 399/90; 399/111; 399/167

(58) Field of Classification Search
CPC ..... G03G 21/1652; G03G 21/181; G03G 21/1821; G03G 21/1825; G03G 21/1857; G03G 21/1867; G03G 2221/1807
USPC ..... 399/90, 110, 111, 114, 119, 167
See application file for complete search history.

(56) References Cited

U.S. PATENT DOCUMENTS

| | | | | |
|---|---|---|---|---|
| 6,937,834 | B2 * | 8/2005 | Kanno et al. | 399/114 |
| 6,947,686 | B2 * | 9/2005 | Kawai et al. | 399/111 |
| 7,062,201 | B2 * | 6/2006 | Mizoguchi | 399/114 |
| 7,072,603 | B2 * | 7/2006 | Tsuzuki et al. | 399/111 |
| 7,463,844 | B2 * | 12/2008 | Hashimoto et al. | 399/111 |
| 8,270,872 | B2 | 9/2012 | Takiguchi et al. | |
| 2003/0185587 | A1 | 10/2003 | Kawai et al. | |
| 2005/0025522 | A1 | 2/2005 | Tsuzuki et al. | |
| 2005/0123319 | A1 | 6/2005 | Mizoguchi | |
| 2007/0071495 | A1 | 3/2007 | Hashimoto et al. | |
| 2010/0209137 | A1 | 8/2010 | Takiguchi et al. | |
| 2011/0229193 | A1 | 9/2011 | Okabe et al. | |
| 2011/0229194 | A1 | 9/2011 | Okabe et al. | |

FOREIGN PATENT DOCUMENTS

| | | |
|---|---|---|
| CN | 1444114 A | 9/2003 |
| CN | 1834823 A | 9/2006 |

(Continued)

OTHER PUBLICATIONS

Aug. 5, 2014—(CN) Office Action—App 201210083980.7.

*Primary Examiner* — William J Royer
(74) *Attorney, Agent, or Firm* — Banner & Witcoff, Ltd.

(57) ABSTRACT

An image forming apparatus may include a process cartridge, an apparatus body and a spacing member. The process cartridge may be detachably mountable to the apparatus body and include a photosensitive unit having a photosensitive member, a developing unit having a developing roller, and a driving input part into which a driving force from the apparatus body is configured to be inputted. The apparatus body may include a driving input member which is configured to input the driving force. Additionally or alternatively, the spacing member may be attached to the process cartridge and configured to space the photosensitive member and the developing roller. The spacing member may include a first cover part which is located between the driving input part and the driving input member and covers at least a portion of the driving input part.

8 Claims, 10 Drawing Sheets

(56) References Cited

FOREIGN PATENT DOCUMENTS

| | | | |
|---|---|---|---|
| CN | 101807024 | A | 8/2010 |
| EP | 1338932 | A2 | 8/2003 |
| EP | 1703341 | A2 | 9/2006 |
| JP | 2007-248618 | | 9/2007 |
| JP | 2011-075645 | | 4/2011 |
| JP | 2011-197407 | | 10/2011 |
| JP | 2011-197408 | | 10/2011 |

* cited by examiner

UPPER
LEFT
REAR
RIGHT
LOWER
FRONT
100
101
102
103
104
110
111
112
113
114
120
130
140
141
142
143
144
150
160

SPACING CONFIGURATION FOR A PROCESS CARTRIDGE AND AN IMAGE FORMING APPARATUS

CROSS-REFERENCE TO RELATED APPLICATIONS

This application claims priority from Japanese Patent Application No. 2011-186885 filed on Aug. 30, 2011, the entire contents of which are incorporated herein by reference.

TECHNICAL FIELD

Aspects of the present invention relate to an image forming apparatus including a process cartridge which is detachably mounted to an apparatus body.

BACKGROUND

In related-art, there is disclosed an image forming apparatus including a process cartridge which is detachably mounted to an apparatus body. Further, there is disclosed a process cartridge which includes a first frame for supporting a photosensitive member and a second frame movably supported by the first frame to allow a developing roller to approach/separate from the photosensitive member (see, JP-A-2007-248618).

Meanwhile, the image forming apparatus may be shipped and transported in a state where the process cartridge is mounted thereon. In this case, if the photosensitive member and the developing roller are brought into contact with each other, a surface of the photosensitive member or a surface of the developing roller may be damaged or dents may be generated thereon due to a vibration during the transportation. For this reason, there is proposed a method for transporting an image forming apparatus in a state where a maintaining member (spacing member), which is disclosed in JP-A-2007-248618, is provided to the process cartridge to space the photosensitive member and the developing roller from each other.

SUMMARY

As the spacing member for spacing the photosensitive member and the developing roller from each other, there is known a related-art spacing member which is detachably provided to the process cartridge and is removed by a user before using the image forming apparatus. However, in the related-art spacing member, a driving force from an apparatus body may be inputted to drive the developing roller when a user forgets to remove the spacing member. Accordingly, there is a risk of an unnecessary stress being applied to developer.

Aspects of the present invention have been made to solve the above-described problems and an object thereof is to provide an image forming apparatus capable of preventing a stress from being applied to the developer due to the driving of the developing roller, and the like.

According to an aspect of the invention, there is provided an image forming apparatus including: a process cartridge, an apparatus body and a spacing member. The process cartridge is detachably mounted to the apparatus body. The process cartridge includes a photosensitive unit having a photosensitive member on which an electrostatic latent image is configured to be formed, a developing unit having a developing roller which is configured to contact with the photosensitive member to supply developer to the photosensitive member, and a driving input part into which a driving force from the apparatus body is configured to be inputted. The apparatus body includes a driving input member which is configured to move inwards and outwards in an axial direction of the developing roller and to input the driving force to the process cartridge when being engaged with the driving input part. The spacing member is attached to the process cartridge and is configured to space the photosensitive member and the developing roller. The spacing member includes a first cover part which is located between the driving input part and the driving input member and covers at least a portion of the driving input part.

According to the above configuration, since the spacing member includes the first cover part which is located between the driving input part and the driving input member and covers at least a portion of the driving input part, when the user forgets to remove the spacing member, the driving input member is not engaged with the driving input part by the presence of the first cover part. Accordingly, the developing roller is not driven. As a result, it is possible to prevent a stress from being applied to developer due to the driving of the developing roller, and the like.

The developing unit may be displaceably provided with respect to the photosensitive unit. Further, the spacing member may include a maintaining part which is engaged with both the photosensitive unit and the developing unit and is configured to maintain a position of the developing unit with respect to the photosensitive unit at a predetermined position.

According to the above configuration, it is possible to suppress rattling between the photosensitive unit and the developing unit during the transportation of the image forming apparatus.

The photosensitive unit may include a positioning part which is configured to position the developing unit by the developing unit being contacted thereto. Further, the maintaining part may be configured to maintain the developing unit to be spaced apart from the positioning part.

If the positioning part and the developing unit are brought into contact with each other during the transportation of the image forming apparatus, there is a possibility that wear is caused due to a friction therebetween. If the wear is caused, there is a risk that the position of the developing unit will not be accurately positioned. According to the above configuration, it is possible to suppress the wear between the positioning part and the developing unit during the transportation of the image forming apparatus. As a result, the position of the developing unit can be accurately positioned as in the time of shipping.

The image forming apparatus may further include a pair of rollers configured to convey a recording sheet. Further, a first roller of the pair of rollers may be supported by the process cartridge and a second roller of the pair of rollers may be supported by the apparatus body. Further, the spacing member may include a roller spacing part which is located between the first roller and the second roller and is configured to space the first roller and the second roller from each other.

There is a possibility that indentation such as dents is formed on the surface of the rollers having elasticity when the pair of rollers is pressed against each other during the transportation/storage of the image forming apparatus. According to the above configuration, the first roller and the second roller are spaced apart from each other, it is possible to prevent indentation from being formed on the surface of the roller.

The process cartridge may include a pair of bosses protruding outward in the axial direction. Further, the apparatus body may include a pair of guide walls configured to guide the bosses when the process cartridge is attached and detached.

Further, the spacing member may include a boss engaging part which is located between the boss and the guide wall and is engaged with the boss.

According to the above configuration, it is possible to suppress the rattling between the apparatus body and the process cartridge during the transportation of the image forming apparatus. Further, since the boss engaging part is arranged between the boss and the guide wall, it is possible to suppress the wear between the boss and the guide wall during the transportation of the image forming apparatus.

The apparatus body may include a cover configured to open and close a mounting part to which the process cartridge is mounted. Further, the spacing member may include an interposing part which is located between the process cartridge and the cover.

According to the above configuration, it is possible to suppress the rattling between the process cartridge and the cover during the transportation of the image forming apparatus.

The driving input member may be configured to be movable inwards and outwards in the axial direction elastically.

According to the above configuration, it is possible to prevent a large force from being applied to the driving input member itself or the first cover part (process cartridge), even in a case where the driving input member advances to engage with the driving input part and is brought into contact with the first cover part.

The process cartridge may include a cartridge side electrode which is electrically connected to a body side electrode provided to the apparatus body. Further, the spacing member may include a second cover part which is located between the body side electrode and the cartridge side electrode and is configured to cover at least a portion of the cartridge side electrode.

According to the above configuration, since the second cover part covers at least a portion of the cartridge side electrode, both electrodes are not brought into contact with each other. Accordingly, it is possible to suppress the wear of both electrodes during the transportation of the image forming apparatus.

According to the present invention, since the spacing member includes the first cover part to cover at least a portion of the driving input part, the developing roller is not driven when the user forgets to remove the spacing member. Thereby, it is possible to prevent a stress from being applied to the developer due to the driving of the developing roller, and the like.

DETAILED DESCRIPTION

Hereinafter, an exemplary embodiment of the present invention will be described suitably by referring to the accompanying drawings. In the following description, first, a laser printer 1 as an example of an image forming apparatus according to the exemplary embodiment will be described briefly. Subsequently, configurations of the characteristic parts of the present invention will be described in detail.

Further, a direction used in the following description refers to a direction with reference to a user using the laser printer 1. That is, a right side in FIG. 1 is referred to as a "front side," a left side in FIG. 1 is referred to as a "rear side," a front side in FIG. 1 is referred to as a "left side" and a back side in FIG. 1 is referred to as a "right side." Further, an upper-lower direction in FIG. 1 is referred to as "upper-lower."

<Schematic Configuration of Laser Printer>

Figure 1:
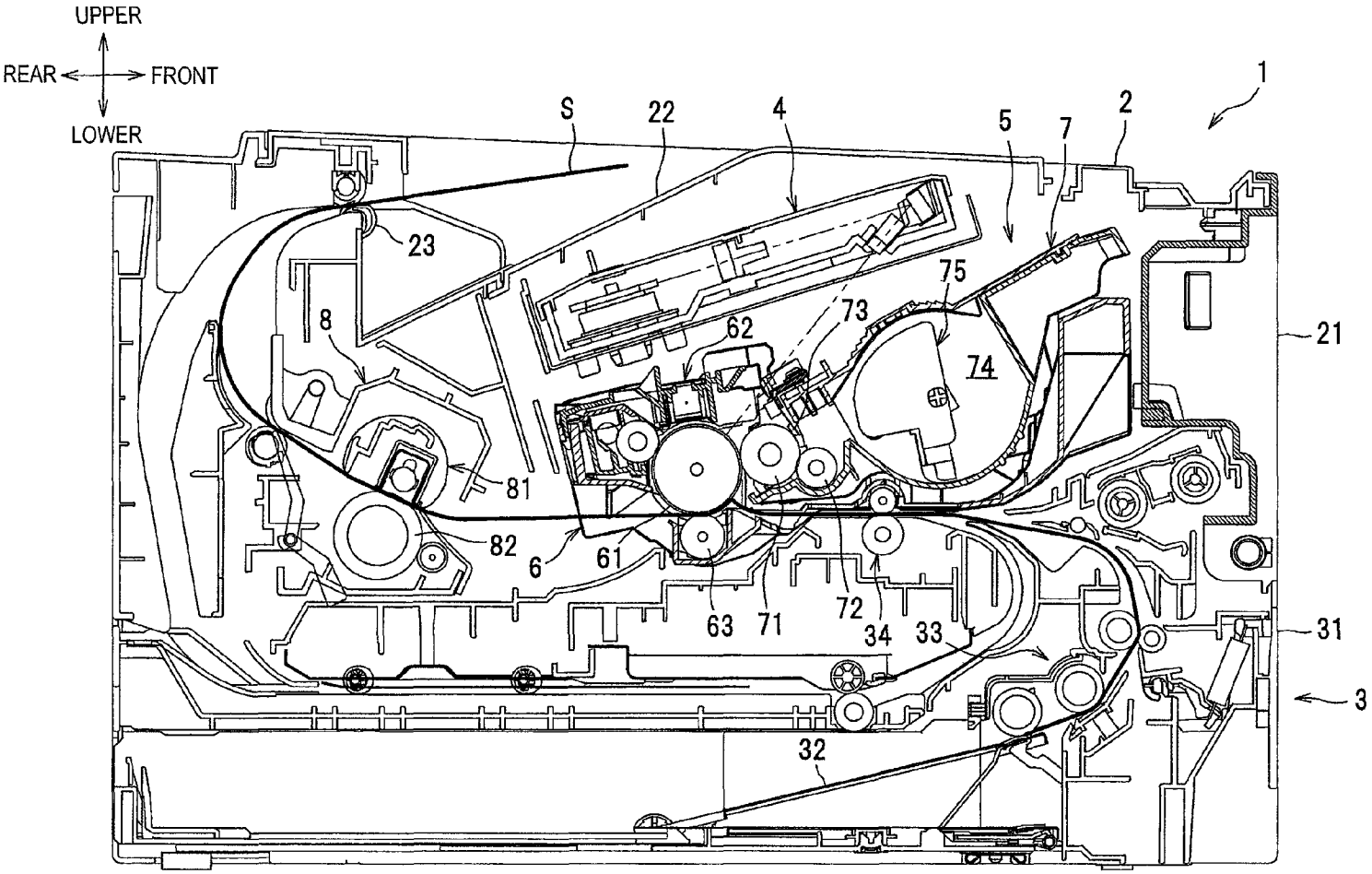
FIG. 1 is a sectional view illustrating a schematic configuration of a laser printer as an example of an image forming apparatus.

As illustrated in FIG. 1, the laser printer 1 mainly includes a sheet feeding unit 3 for feeding a sheet S as an example of a recording sheet, an exposure unit 4, a process cartridge 5 for transferring a toner image (developer image) on the sheet S and a fixing unit 8 for thermally fixing the toner image on the sheet S, which are provided with a body casing 2 as an example of an apparatus body.

The sheet feeding unit 3 is provided in a lower portion of the body casing 2 and mainly includes a sheet feeding tray 31, a sheet pressing plate 32, a sheet feeding mechanism 33 and a register roller 34 as an example of a pair of rollers. The sheet S accommodated in the sheet feeding tray 31 is transmitted upward by the sheet pressing plate 32 and fed toward the process cartridge 5 by the sheet feeding mechanism 33. And then, the sheet S passes through the register roller 34 and is conveyed between a photosensitive drum 61 and a transfer roller 63.

The exposure unit 4 is provided in an upper portion of the body casing 2 and includes a laser emitting unit (not illustrated), a polygon mirror, lens and a reflector mirror which are illustrated without reference numerals. In this exposure unit 4, a laser beam (see, chained line) based on an image data emitted from the laser emitting unit scans the surface of the photosensitive drum 61 in a high speed. In this way, the surface of the photosensitive drum 61 is exposed.

The process cartridge 5 is disposed lower to the exposure unit 4 and is configured to be detachably mounted to the body casing 2 through an opening created by opening a front cover 21 as an example of a cover provided to the body casing 2. The process cartridge 5 includes a photosensitive unit 6 and a developing unit 7.

The photosensitive unit 6 mainly includes the photosensitive drum 61 as an example of a photosensitive member, a scorotron-type charger 62 including a corona wire and a grid which are illustrated without reference numerals, and the transfer roller 63.

The developing unit 7 is configured to be detachably mounted to the photosensitive unit 6. The developing unit 7 is configured to be detachably mounted to the body casing 2 in a state of being mounted to the photosensitive unit 6. That is, the developing unit 7 is detachably mounted to the body casing 2 as a part of the process cartridge 5. The developing unit 7 mainly includes a developing roller 71, a supply roller 72, a thickness restricting blade 73, a toner accommodating part 74 for accommodating a toner as an example of developer and an agitator 75.

In the process cartridge 5, the surface of the photosensitive drum 61 is uniformly charged by the charger 62 and then exposed by a high speed scanning of a laser beam from the exposure unit 4. In this way, an electrostatic latent image based on the image data is formed on the photosensitive drum 61. Further, the toner in the toner accommodating part 74 is first supplied to the supply roller 72 while being agitated by the agitator 75 and then supplied from the supply roller 72 to the developing roller 71. The toner enters between the developing roller 71 and the thickness restricting blade 73 by the rotation of the developing roller 71 to be supported on the developing roller 71 as a thin layer having a constant thickness.

The toner supported on the developing roller 71 is supplied from the developing roller 71 to the electrostatic latent image formed on the photosensitive drum 61. Thereby, the electrostatic latent image becomes a visible image and the toner image is formed on the photosensitive drum 61. Thereafter, as the sheet S is conveyed through between the photosensitive drum 61 and the transfer roller 63, the toner image on the photosensitive drum 61 is transferred onto the sheet S.

The fixing unit 8 is located rear to the process cartridge 5 and mainly includes a heating unit 81 and a pressing roller 82. The heating unit 81 has a halogen heater, a fixation belt and a nip plate which are illustrated without reference numeral. The pressing roller 82 is configured to hold the fixation belt between the nip plate of the heating unit 81. In the fixing unit 8, the toner image transferred onto the sheet S is thermally fixed while the sheet S passes through between the heating unit 81 and the pressing roller 82. The sheet S onto which the toner image is thermally fixed is discharged onto a sheet discharge tray 22 by a sheet discharge roller 23.

<Configuration of Process Cartridge>

Next, a configuration of the process cartridge 5 (photosensitive unit 6 and developing unit 7) related to a characteristic part of the present invention will be described.

Figure 2:
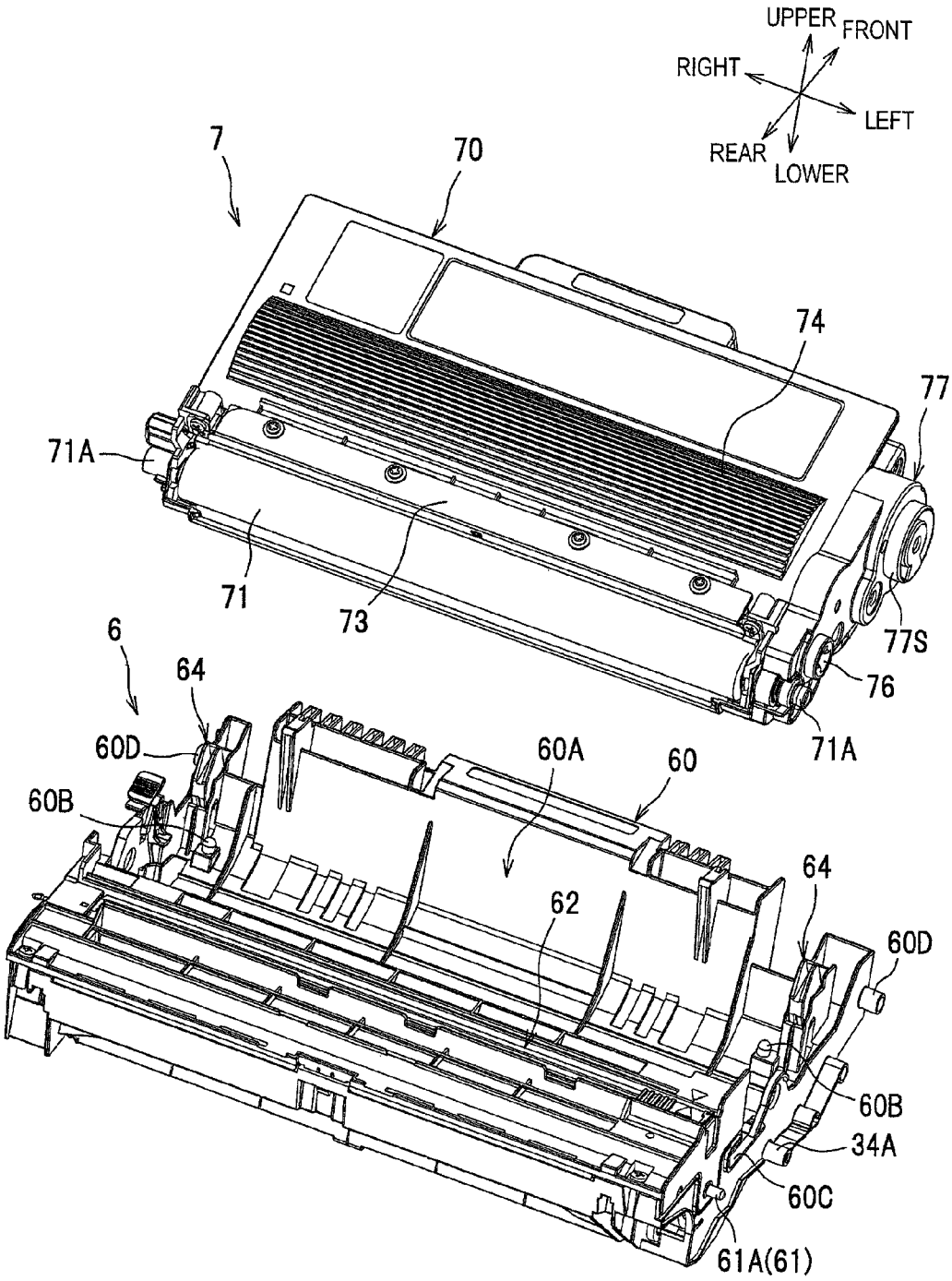
FIG. 2 is a perspective view of a photosensitive unit and a developing unit.

As illustrated in FIG. 2, the developing unit 7 further includes a developing frame 70, a coupling 76 as an example of a driving input part and a cover body 77, in addition to the developing roller 71 and the supply roller 72 mentioned above.

The developing frame 70 is a member which rotatably supports the developing roller 71 or the supply roller 72 and defines the toner accommodating part 74.

Figure 3:
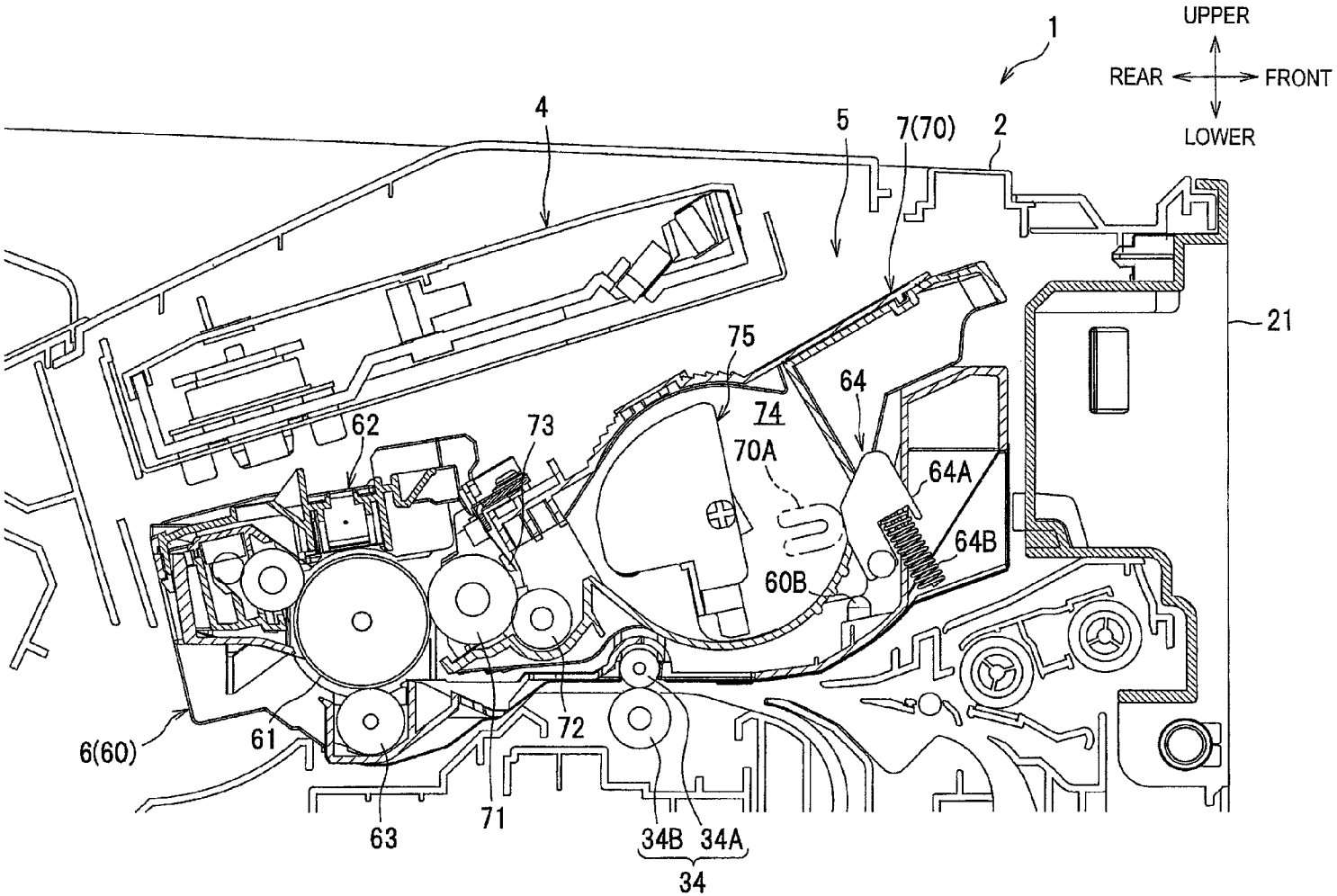
FIG. 3 is an enlarged sectional view of the laser printer.
Figure 9A:
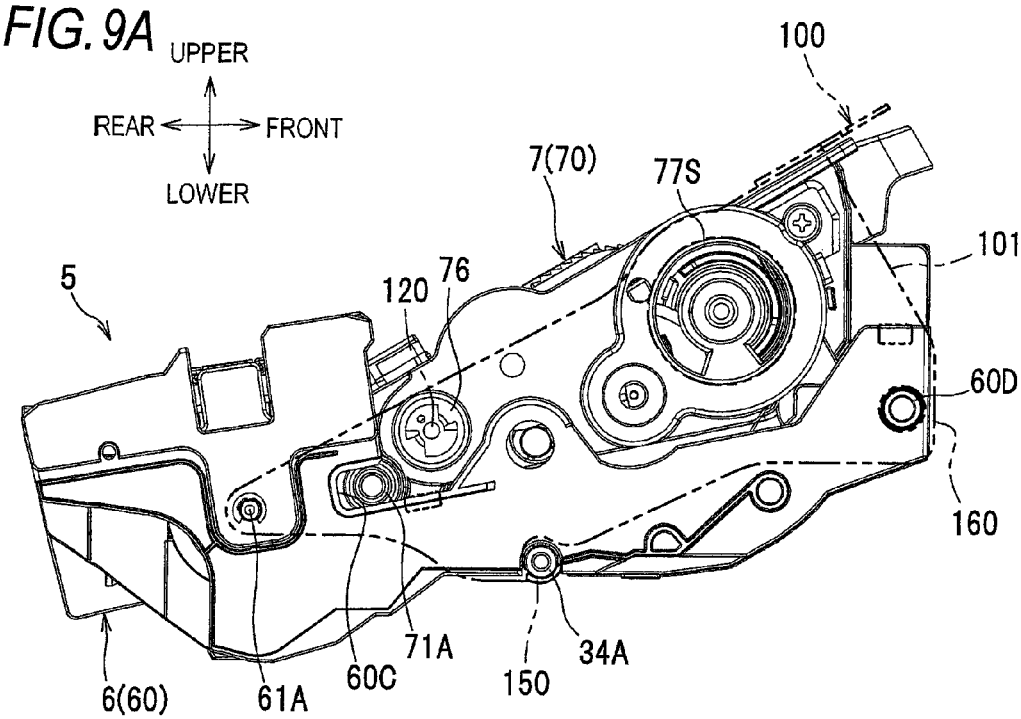
FIG. 9A is a side view of the process cartridge to which the spacing member is attached as viewed from the left side and FIG. 9B is a side view of the process cartridge as viewed from the right side.
Figure 9B:
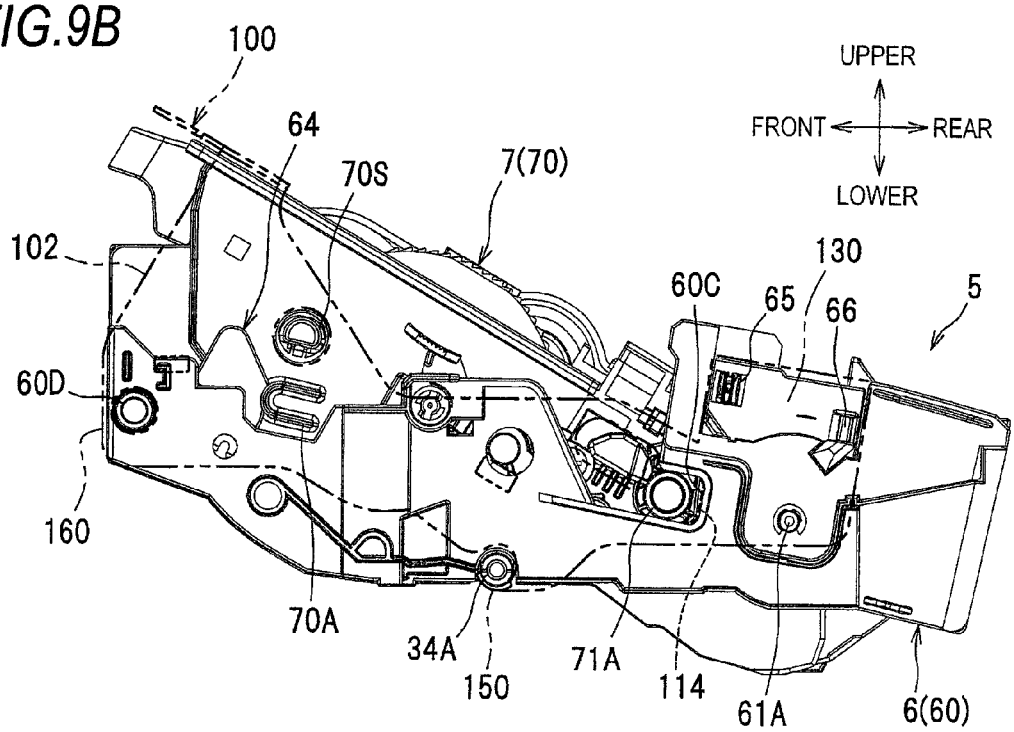

As illustrated in FIGS. 3 and 9B, a pressed part 70A protruding outwards in the left-right direction (axial direction of the developing roller 71) is provided to a front side of outer surfaces of the left and right side walls of the developing frame 70. The pressed part 70A is a portion which is pressed by a pressing member 64 (will be described later) of the photosensitive unit 6 when the developing unit 7 is mounted to the photosensitive unit 6.

Figure 8B:
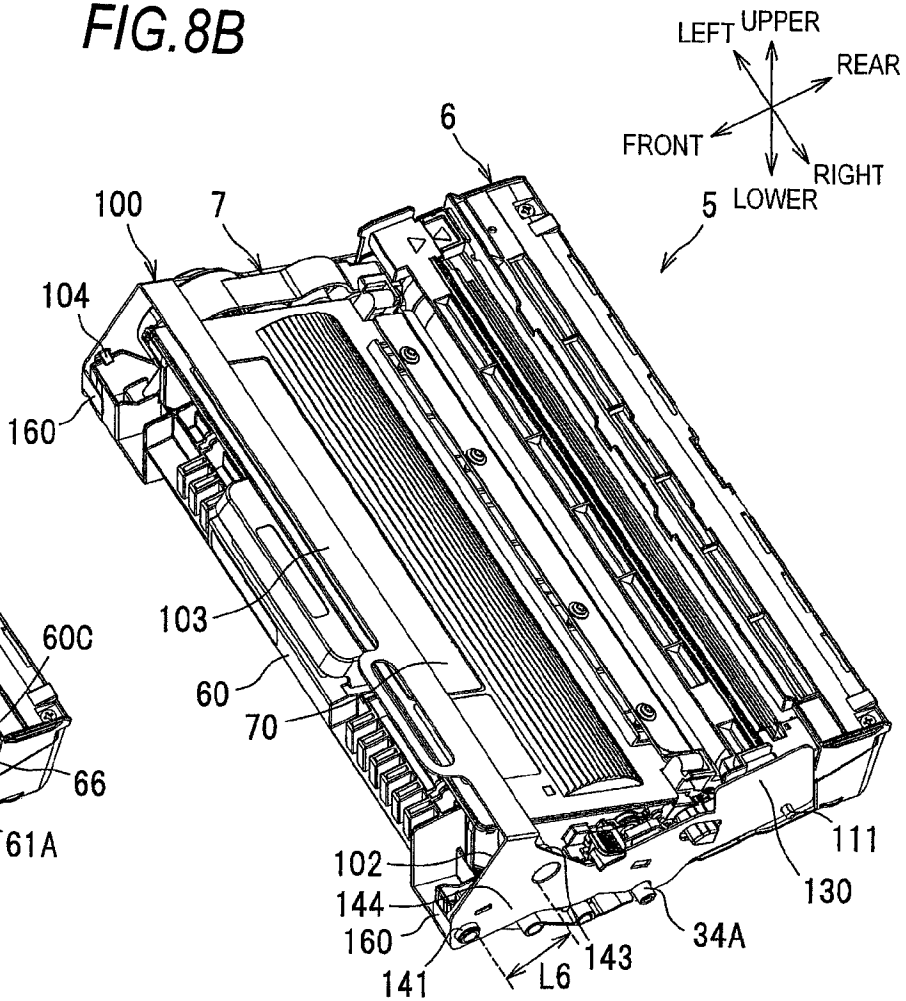
FIG. 8A is a perspective view of a process cartridge as viewed from the right side and FIG. 8B is a perspective view of the process cartridge in a state where the spacing member is attached thereto.
Figure 8A:
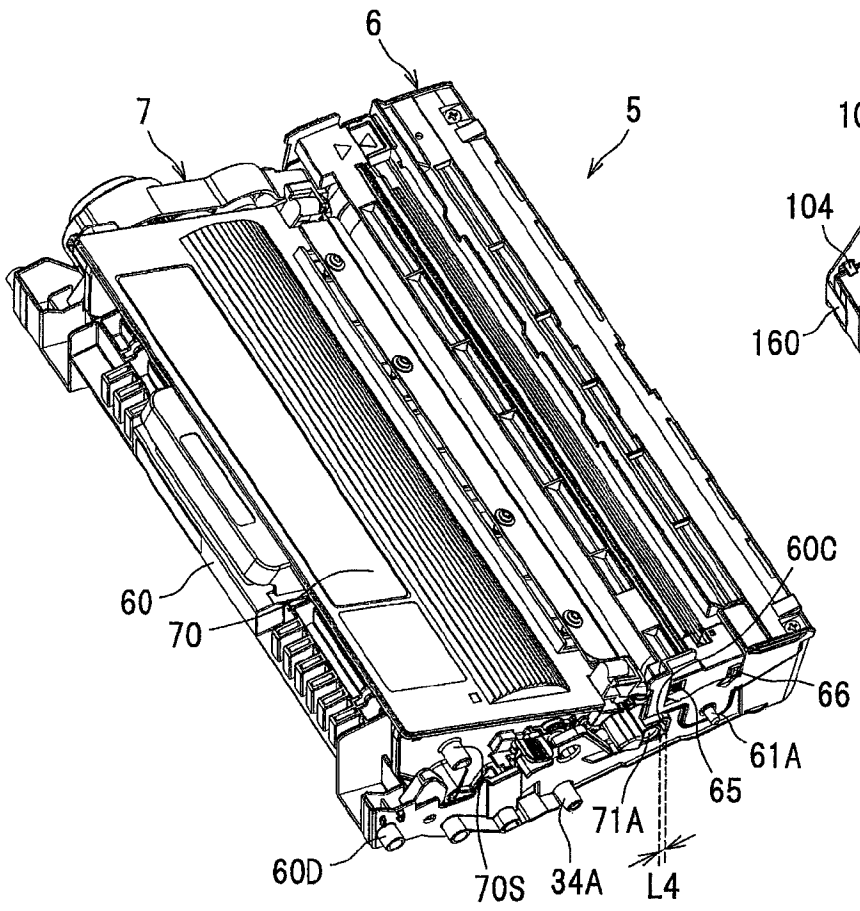

Further, as illustrated in FIG. 8A, a convex part 70S protruding outwards in the left-right direction is provided upper to the pressed part 70A to a right side wall of the developing frame 70. A right convex part engaging part 143 (see, FIG. 8B) of a spacing member 100, which will be described later, is configured to be engaged with the convex part 70S.

Returning back to FIG. 2, the coupling 76 is a member into which a driving force from the body casing 2 is inputted. The coupling 76 is rotatably supported on a left side wall of the developing frame 70. The driving force inputted into the coupling 76 is transmitted to the developing roller 71, the supply roller 72 and the agitator 75 via a known driving force transmitting mechanism which is not illustrated. The driving force transmitting mechanism is provided to a left side surface of the developing frame 70, and an example thereof is a plurality of gears. Thereby, the developing roller 71, the supply roller 72 and the agitator 75 can be driven.

The cover body 77 is a member which is mounted to a left side wall of the developing frame 70 to cover the coupling 76 or the driving force transmitting mechanism mentioned above. A convex part 77S protruding outwards in the left-right direction is provided to a front side in an outer surface of the cover body 77. A left convex part engaging hole 112 (see, FIGS. 5A, 5B) of the spacing member 100 can be engaged with the convex part 77S.

The photosensitive unit 6 further includes a photosensitive frame 60, a driven roller 34A as an example of a first roller of a pair of register rollers 34, a pressing member 64, a wire electrode 65 and a gird electrode 66 (see, FIG. 9B) as an example of a cartridge side electrode, in addition to the photosensitive drum 61 and the charger 62 mentioned above.

The photosensitive frame 60 is a member configured to rotatably support the photosensitive drum 61 or the driven roller 34A and form a concave detaching part 60A to which the developing unit 7 is detachably mounted. A positioning part 60B protruding upward is provided to both left and right sides at a front end of a lower wall of the detaching part 60A. An upper end of the positioning part 60B has an approximately hemi-spherical shape.

As illustrated in FIG. 3, a front side of the developing unit 7 is brought into contact with the upper end of the positioning part 60B from the upper side when the developing unit 7 is mounted to the photosensitive unit 6. Thereby, the developing unit 7 can be positioned with respect to the photosensitive unit 6.

As illustrated in FIG. 2, a concave engaging part 60C opening toward the front side is provided near a central portion in the front-rear direction to the left and right side walls of the photosensitive frame 60. A shaft 71A of the developing roller 71 is engaged with the concave engaging part 60C when the developing unit 7 is mounted to the photosensitive unit 6 (see, FIG. 9).

Further, a pair of bosses 60D protruding outwards in the left-right direction is provided to the front ends of the left and right side walls of the photosensitive frame 60. The bosses 60D have an approximately cylindrical shape.

The pressing member 64 is a member which presses the developing unit 7 mounted to the photosensitive unit 6 toward the rear to urge the developing roller 71 to the photosensitive drum 61. The pressing member 64 is provided adjacent to the positioning part 60B, obliquely at the front side of the positioning part 60B and outside of the positioning part 60B in the left-right direction. The pressing member 64 mainly includes a pressing arm 64A and a coil spring 64B, as illustrated in FIG. 3.

The pressing arm 64A is supported by the photosensitive frame 60 to swing in the front-rear direction around a lower end thereof. Further, the coil spring 64B is disposed between the pressing arm 64A and the photosensitive frame 60 and urges a portion of the pressing arm 64A which is located at a rear side and farther to the rear than a swing axis thereof in an approximately upper direction.

The pressing member 64 presses the pressed part 70A of the developing unit 7 obliquely toward the rear and lower side when the developing unit 7 is mounted to the photosensitive unit 6. Thereby, the entire developing unit 7 is urged obliquely toward the rear and lower side and thus the developing roller 71 is urged toward the photosensitive drum 61. Further, as the entire developing unit 7 is urged obliquely toward the rear and lower side, a front side of the developing frame 70 is pressed against the upper end of the positioning part 60B. In this way, the position of the developing unit 7 can be securely positioned.

The driven roller 34A is disposed upper to a pressing roller 34B as an example of a second roller of the pair of register roller 34 supported by the body casing 2 when the process cartridge 5 is mounted to the body casing 2. In the register roller 34, the driven roller 34A is rotationally driven by the rotation driving of the pressing roller (e.g., driving roller) 34B and thus sheet S is conveyed toward between the photosensitive drum 61 and the transfer roller 63.

As illustrated in FIG. 9B, the wire electrode 65 and the grid electrode 66 are electrically connected to a first electrode 25 and a second electrode 26 (see, FIG. 4) which are provided to the body casing 2. The wire electrode 65 and the grid electrode 66 are arranged to an upper portion of the rear side of a right side wall of the photosensitive frame 60.

More specifically, the wire electrode 65 is electrically connected to the corona wire of the charger 62. The wire electrode 65 is electrically connected to the first electrode 25 when the process cartridge 5 is mounted to the body casing 2. Further, the grid electrode 66 is electrically connected to the grid of the charger 62. The grid electrode 66 is electrically connected to the second electrode 26 when the process cartridge 5 is mounted to the body casing 2.

<Configuration of Body Casing>

Figure 4:
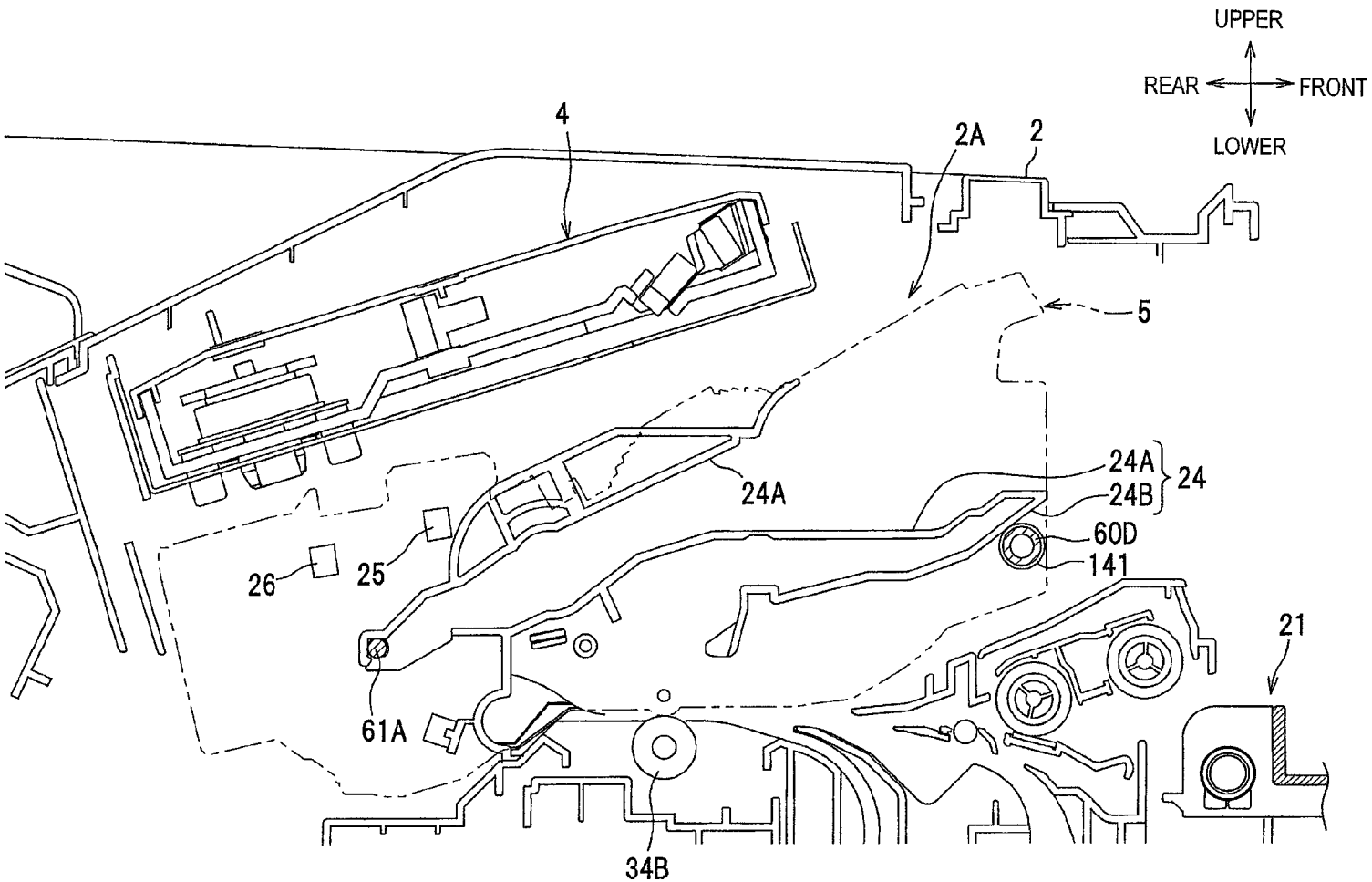
FIG. 4 is an enlarged sectional view of an inner configuration of the body casing.

Next, a configuration of the body casing 2 related to a characteristic part of the present invention will be described. As illustrated in FIG. 4, the body casing 2 includes a mounting part 2A, a pair of left and right guides 24 (only one thereof is illustrated), the first electrode 25 and the second electrode 26 as an example of a body side electrode and a driving input member 27 (see, FIGS. 7A and 7B).

The mounting part 2A is a portion inside the body casing 2, to which the process cartridge 5 is mounted. The mounting part 2A is formed between the left and right side walls of the body casing 2. The mounting part 2A is configured to be opened and closed by the front cover 21.

The guides 24 are configured to guide the process cartridge 5 up to a mounting position (position illustrated in FIG. 1) and respectively provided to an inner surface of the left and right side walls of the body casing 2. In the present exemplary embodiment, the guides 24 mainly include a drum guide 24A for guiding a drum shaft 61A and a boss guide 24B as an example of a pair of guide walls for guiding the bosses 60D when the process cartridge 5 is attached or detached.

The first electrode 25 and the second electrode 26 are respectively provided to an inner surface of the right wall of the body casing 2. Further, a bias applying device (not illustrated) is provided inside the body casing 2. When the charger 62 of the process cartridge 5 is driven during image formation, the bias applying device applies a predetermined bias to the wire electrode 65 (corona electrode) via the first electrode 25 and applies a predetermined bias to the grid electrode 66 (grid) via the second electrode 26.

Figure 7B:
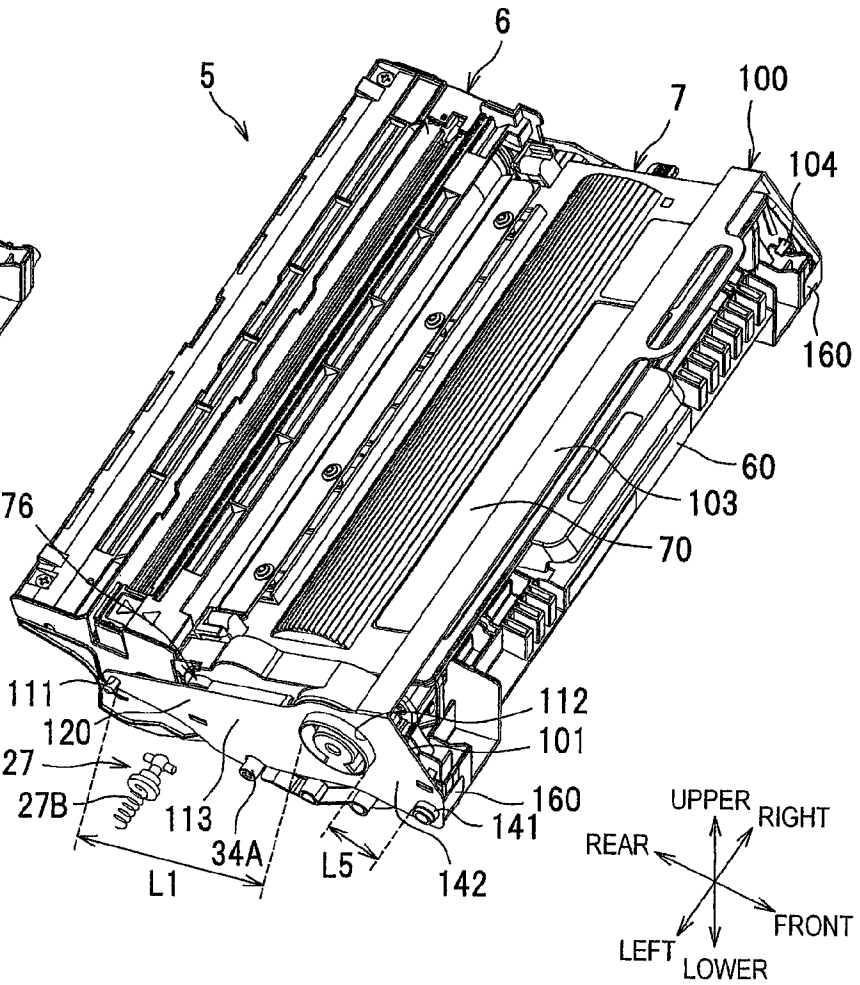
FIG. 7A is a perspective view of a process cartridge as viewed from the left side and FIG. 7B is a perspective view of the process cartridge in a state where the spacing member is attached thereto.
Figure 7A:
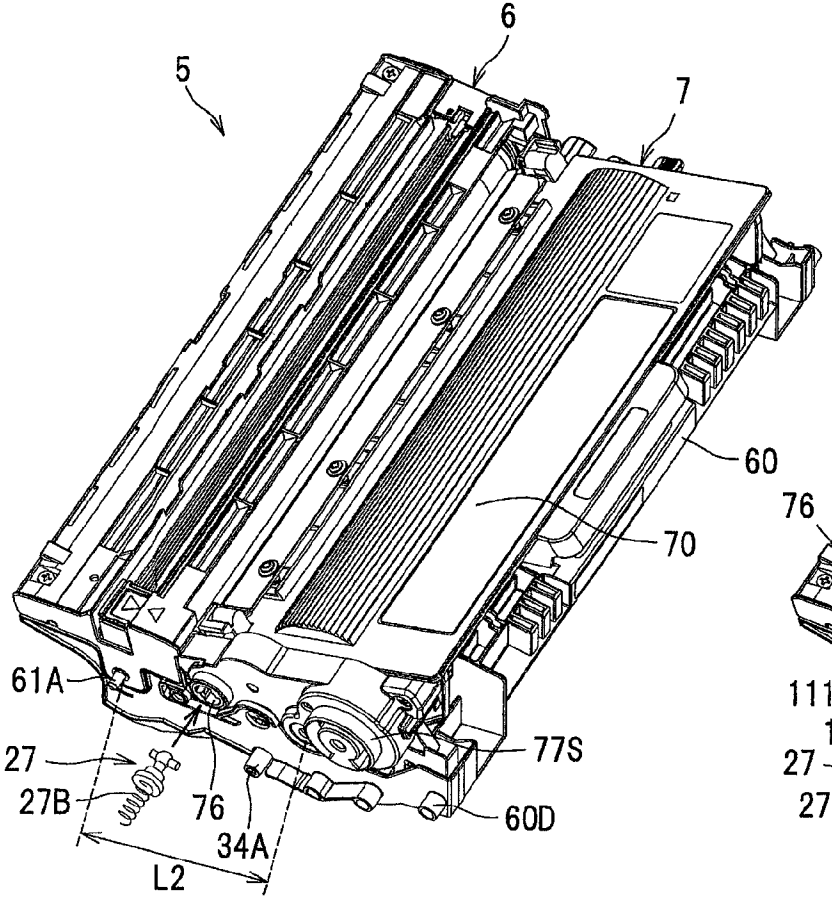

As illustrated in FIG. 7A, the driving input member 27 is a member inputting a driving force from a motor (not illustrated) provided within the body casing 2 to the coupling 76 of the process cartridge 5. The driving input member 27 is supported by a left side wall of the body casing 2 and is configured to move inwards and outwards in the left-right direction. The driving input member 27 can be operated by a known mechanism. Specifically, the driving input member 27 advances inwards in the left-right direction in accordance with an operation for closing the front cover 21. And thus, the driving input member 27 is engaged with the coupling 76 of the mounted process cartridge 5 to transmit the driving force. Further, the driving input member 27 retreats outwards in the left-right direction in accordance with an operation for opening the front cover 21 and thus is disengaged from the coupling 76.

In the present exemplary embodiment, the driving input member 27 is configured to be movable inwards and outwards in the left-right direction elastically by the action of a spring 27B. Thereby, even if the driving input member 27 advancing inwards in the left-right direction is subjected to a force directed outwards in the left-right direction, it is possible to reduce the force applied on the driving input member 27 by contraction of the spring 27B.

<Detailed Configuration of the Spacing Member>

The laser printer 1 according to the present exemplary embodiment is shipped from a factory in a state where the process cartridge 5 is mounted thereon. At this time, the spacing member 100 illustrated in FIG. 5 is mounted to the process cartridge 5 in order to space the photosensitive drum 61 and the developing roller 71 from each other (see, FIG. 7B and FIG. 8B).

As an example, the spacing member 100 is made of polypropylene resin and is configured by a single member. The spacing member 100 includes a left part 101 attached to a left side of the process cartridge 5, a right part 102 attached to a right side thereof and a connecting part 103 which extends in the left-right direction and connects the front upper ends of the left part 101 and the right part 102 with each other.

Two engaging claws 104 protruding inwards in the left-right direction are respectively provided to each of the left part 101 and the right part 102. That is, a total of four engaging claws 104 are provided. When the spacing member 100 is attached to the process cartridge 5, each of the engaging claws 104 is engaged with the photosensitive frame 60. Accordingly, it is possible to prevent the spacing member 100 from being separated from the process cartridge 5 due to a vibration during the transportation.

The spacing member 100 includes a first spacing part 110, a first cover part 120, a second cover part 130, a maintaining part 140, a second spacing part 150 as an example of a roller spacing part and an interposing part 160 as functioning parts corresponding to the characteristic part of the present invention.

In the following description, a state where the spacing member 100 is attached to the process cartridge 5 is referred to as an attached state and a state where the spacing member 100 is not attached to the process cartridge 5 is referred to as a detached state.

The first spacing part 110 is configured to space the photosensitive drum 61 apart from the developing roller 71. The first spacing part includes a drum engaging hole 111, the left convex part engaging hole 112 and a left first wall 113 which are provided to the left part 101. The first spacing part also includes a convex engaging part 114 which is provided to the right part 102.

The drum engaging hole 111 is a through hole which is engaged with the drum shaft 61A of the photosensitive drum 61 and provided to a rear end of the left part 101. In the present exemplary embodiment, the drum engaging hole 111 is also provided to a rear end of the right part 102.

The left convex part engaging hole 112 is a through hole which is engaged with the convex part 77S of the process cartridge 5 and provided to an upper portion of a front side of the left part 101.

The left first wall 113 is a portion of the wall constituting the left part 101 between the drum engaging hole 111 and the left convex part engaging hole 112. As illustrated in FIG. 7B, the left side wall 113 have a length L1 (shortest length from the drum engaging hole 111 to the left convex part engaging hole 112) slightly longer than a shortest length L2 from the drum shaft 61A to the convex part 77S in a detached state.

Figure 6:
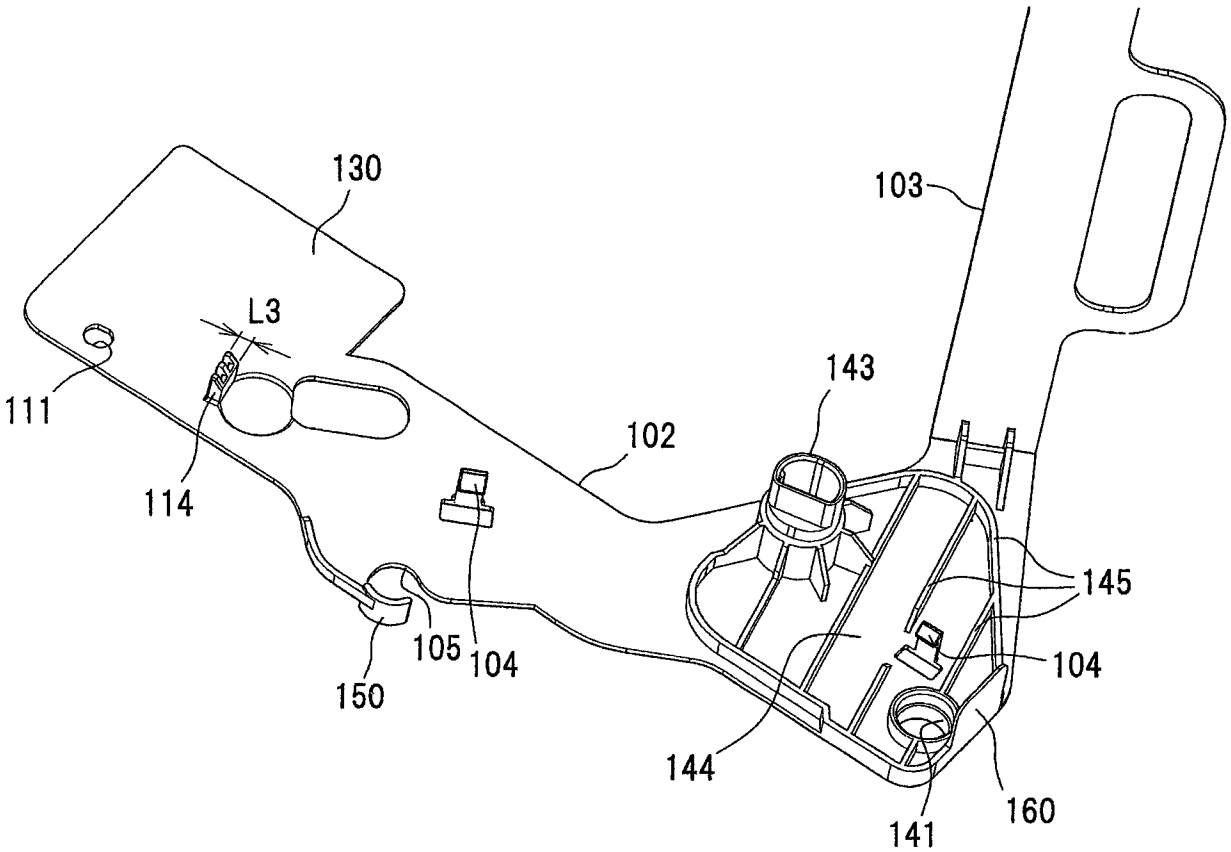
FIG. 6 is a perspective view of a right side portion of the spacing member as viewed from an inner side.

As illustrated in FIG. 6, the convex engaging part 114 is a portion which is engaged between the shaft 71A of the developing roller 71 and the rear wall of the concave engaging part 60C. The convex engaging part 114 is provided at a front side of the drum engaging hole 111 to protrude from an inner surface of the right part 102 inwardly in the left-right direction. The convex engaging part 114 has a length L3 in a substantially longitudinal direction slightly longer than a shortest length L4 (see, FIG. 8A) from the shaft 71A to the rear wall of the concave engaging part 60C in the detached state.

Returning back to FIG. 5A, the first cover part 120 is a part of the left first wall 113 and is arranged to cover the coupling 76 from the outside in the left-right direction, in an attached state (see, FIG. 7B).

The second cover part 130 is a portion of a rear end of the right part 102 that protrudes upwards and is arranged to cover the wire electrode 65 and the grid electrode 66 from the outside in the left-right direction, in the attached state (see, FIG. 8A).

The maintaining part 140 is configured to maintain the position of the developing unit 7 with respect to the photosensitive unit 6 in a predetermined position and includes a boss engaging part 141, the left convex part engaging hole 112, a left maintaining wall 142, a right convex part engaging part 143 (see, FIG. 6) and a left maintaining wall 144.

The boss engaging part 141 is an approximately cylindrical part which is engaged with the boss 60D of the photosensitive frame 60 and is provided to protrude from the front ends of the left part 101 and the right part 102 toward both sides in the left-right direction.

The left maintaining wall 142 is a portion of the wall constituting the left part 101 between the boss engaging part 141 and the left convex part engaging hole 112. As illustrated in FIG. 7B, a shortest length L5 from an inner peripheral surface of the boss engaging part 141 of the left maintaining wall 142 to the left convex part engaging hole 112 is set such that the convex part 77S (developing unit 7) engaged with the left convex part engaging hole 112 is spaced apart from the positioning part 60B of the photosensitive unit 6, in the attached state (see, also FIG. 10).

As illustrated in FIG. 6, the right convex part engaging part 143 is a cylindrical part which is engaged with the convex part 70S of the process cartridge 5 and is provided to protrude obliquely from the rear and upper side of the boss engaging part 141 inwards in the left-right direction.

The right maintaining wall 144 is a portion of the wall constituting the right part 102 between the boss engaging part 141 and the right convex part engaging hole 143. As illustrated in FIG. 8B, a shortest length L6 from an inner peripheral surface of the boss engaging part 141 of the right maintaining wall 144 to an inner peripheral surface of the right convex part engaging part 143 is set such that the convex part 70S (developing unit 7) engaged with the right convex part engaging hole 143 is spaced apart from the positioning part 60B of the photosensitive unit 6 in the attached state (see, also FIG. 10). Further, as illustrated in FIG. 6, a rib 145 is provided to an inner surface of the right maintaining wall 144 to protrude toward inwards in the left-right direction.

Figures 5A, 5B:
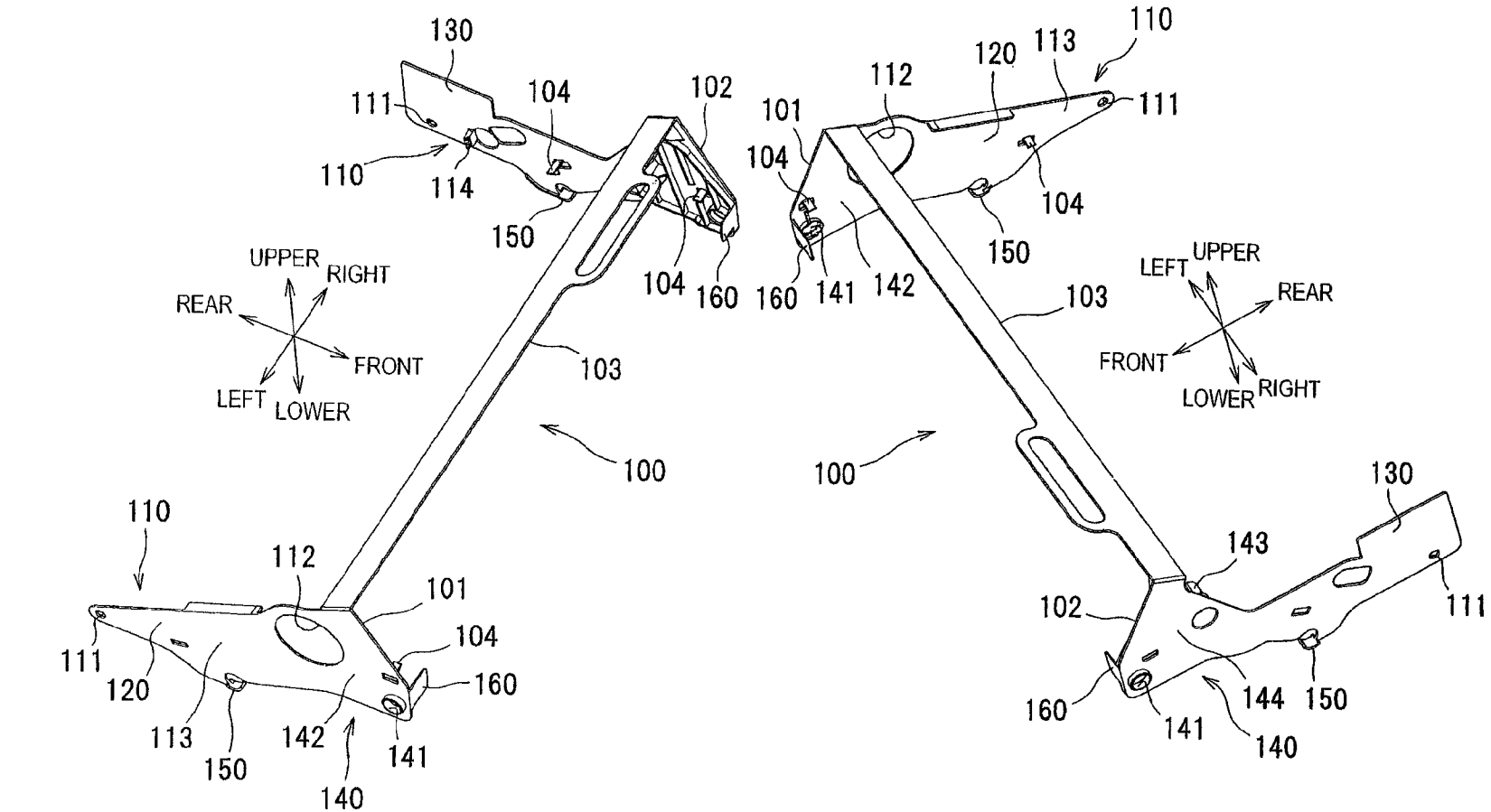
FIG. 5A is a perspective view of a spacing member as viewed from a left side and FIG. 5B is a perspective view of the spacing member as viewed from a right side.

As illustrated in FIG. 5A, the second spacing part 150 is configured such that the register rollers 34 (driven roller 34A and driving roller 34B) are spaced apart from each other. A concave part 105 (see, FIG. 6) accommodating both left and right ends of the driven roller 34A is formed to a lower portion of the left part 101 and the right part 102 around a central portion thereof in the front and rear directions, in the attached state. The second spacing part 150 is provided to extend from a rear edge of the concave part 105 toward the front side in an approximately bow shape as viewed from the side.

The second spacing part 150 is formed to be wide in the left-right direction (that is, thicker than the wall constituting the left part 101 and the right part 102) and is arranged to cover both left and right ends of the driven roller 34A from the below in the attached state.

The interposing part 160 is configured to prevent contact between the process cartridge 5 and the front cover 21. The interposing part 160 is formed to extend from the front ends of the left part 101 and the right part 102 toward the inside in the left-right direction in a substantially plate shape.

<Explanation of Function of Spacing Member>

Next, the function of each part of the spacing member 100 will be described.

When the spacing member 100 is attached to the process cartridge 5, in the left part 101, the drum engaging hole 111 is engaged with the drum shaft 61A, the left convex part engaging hole 112 is engaged with the convex part 77S and the boss engaging part 141 is engaged with the boss 60D, as illustrated in FIG. 7. Further, the left end of the driven roller 34A is engaged with the second spacing part 150, as illustrated in FIG. 9A.

Further, in the right part 102, the convex engaging part 114 is engaged between the shaft 71A and the concave engaging part 60C and the right convex part engaging part 143 is engaged with the convex part 70S while the drum engaging hole 111 is engaged with the drum shaft 61A and the boss engaging part 141 is engaged with the boss 60D, as illustrated in FIG. 8B. Further, the right end of the driven roller 34A is engaged with the second spacing part 150, as illustrated in FIG. 9B. Thereby, the spacing member 100 is attached to the process cartridge 5.

As mentioned above, since the length L1 of the left side wall 113 is set longer than the shortest length L2 from the drum shaft 61A to the convex part 77S in the detached state, the convex part 77S (developing unit 7) in the attached state is spaced farther apart from the drum shaft 61A than in the detached state by support of the left side wall 113. Further, since the length L3 of the convex engaging part 114 is set longer than the shortest length L4 from the shaft 71A to the rear wall of the concave engaging part 60C in the detached state, the convex engaging part 114 is engaged between the shaft 71A and the rear wall of the concave engaging part 60C. Accordingly, the shaft 71A (developing unit 7) in the attached state is spaced farther apart from the drum shaft 61A than in the detached state.

Figure 10:
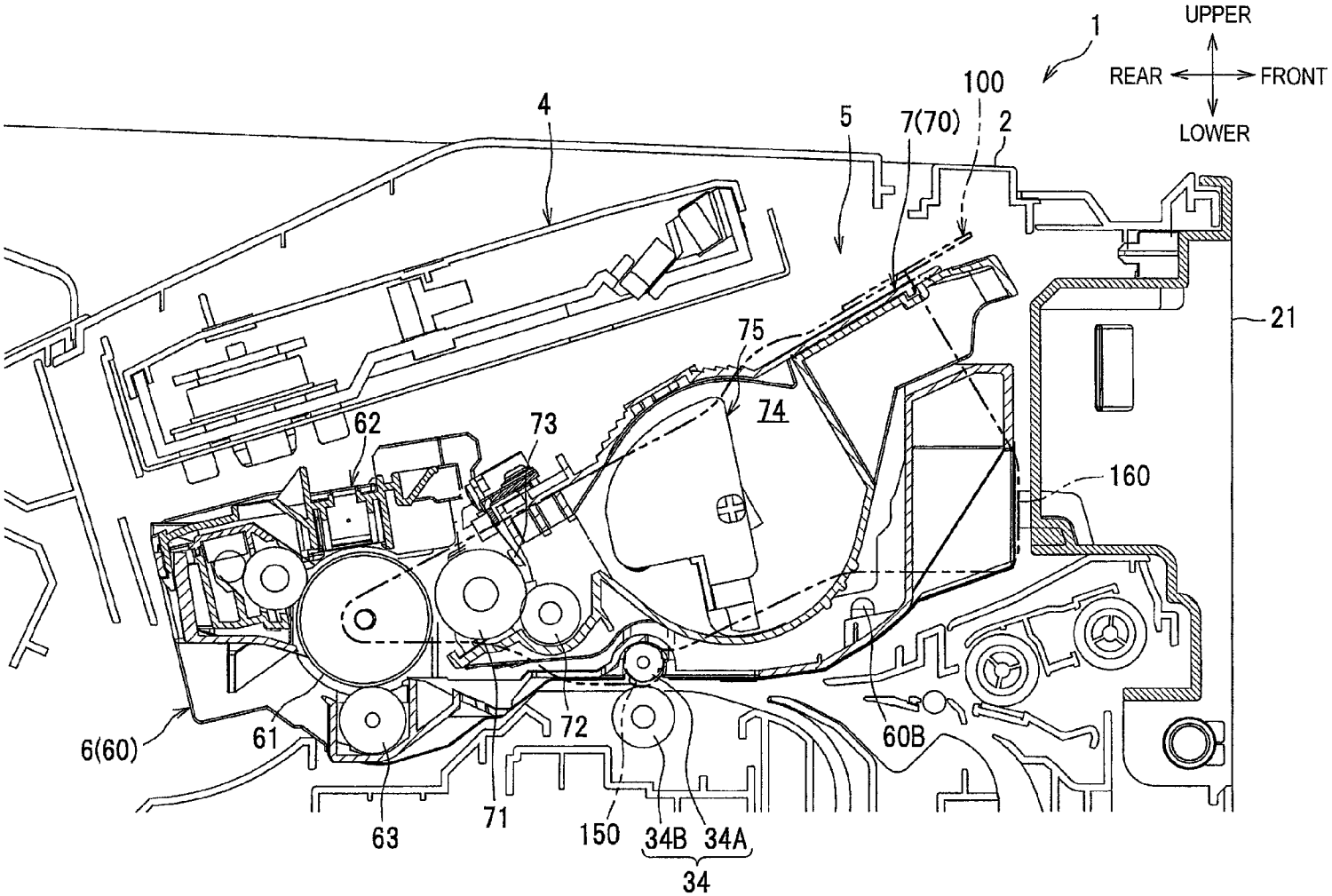
FIG. 10 is an enlarged sectional view of the laser printer on which the process cartridge having the spacing member is attached.

According to these configurations, the developing roller 71 supported by the developing unit 7 (developing frame 70) is spaced apart from the photosensitive drum 61 (see, FIG. 10). As a result, it is possible to prevent the surface of the photosensitive drum 61 or the developing roller 71 to be damaged or dents to be generated thereon during the transportation of the laser printer 1 on which the process cartridge 5 is mounted.

Meanwhile, in a case where the developing unit 7 can be attached or detached from the photosensitive unit 6, there is a slight rattling between the developing unit 7 and the photosensitive frame 60. However, in the present exemplary embodiment, the spacing member 100 as a single member is engaged with both the photosensitive unit 6 and the developing unit 7. Specifically, the boss engaging part 141 is engaged with the boss 60D (photosensitive unit 6) and the left convex part engaging hole 112 and the right convex part engaging part 143 are engaged with the convex parts 77S, 70S (developing unit 7). Accordingly, the developing unit 7 is maintained in a predetermined position with respect to the photosensitive unit 6. Thereby, it is possible to suppress the rattling between the photosensitive unit 6 and the developing unit 7 during the transportation of the laser printer 1.

Further, in the present exemplary embodiment, the convex part 77S engaged with the left convex part engaging hole 112 is spaced apart from the positioning part 60B of the photosensitive unit 6 by the support of the left maintaining wall 142. Furthermore, the convex part 70S engaged with the right convex part engaging part 143 is spaced apart from the positioning part 60B by the support of the right maintaining wall 144. Consequently, the front portion of the developing unit 7 is maintained in a state of being spaced apart from the positioning part 60B (see, FIG. 10). Thereby, it is possible to suppress the wear between the positioning part 60B and the developing unit 7 during the transportation of the laser printer 1. Accordingly, when the spacing member 100 is removed (when the laser printer 1 is used), the position of the developing unit 7 can be accurately positioned as in the time of shipping.

As illustrated in FIG. 8B, the right maintaining wall 144 is disposed at a position spaced apart from a right side surface of the developing unit 7 in the attached state. However, since the rib 145 (see, FIG. 6) is provided to an inner surface of the right maintaining wall 144 in the present exemplary embodiment, the rigidity of the right maintaining wall 144 is improved. Accordingly, since the right maintaining wall 144 can be supported without being flexed, it is possible to space the convex part 70S and the boss 60D from each other.

As illustrated in FIG. 10, when the process cartridge 5 to which the spacing member 100 is attached is mounted to the body casing 2, the second spacing part 150 is located between the driven roller 34A and the driving roller 34B. Thereby, the driven roller 34A and the driving roller 34B are spaced apart from each other. Accordingly, it is possible to prevent an indentation from being caused on the surface of the register rollers 34 during the transportation of the laser printer 1.

Further, when the process cartridge 5 to which the spacing member 100 is attached is mounted to the body casing 2, a peripheral wall of the boss engaging part 141 having an approximately cylindrical shape is located between the boss 60D and the boss guide 24B (see, FIG. 4). Thereby, it is possible to suppress the rattling between the boss guide 24B (body casing 2) and the process cartridge 5 during the transportation of the laser printer 1. Further, since the boss engaging part 141 is located between the boss 60D and the boss guide 24B, it is also possible to suppress the wear between the boss 60D and the boss guide 24B during the transportation of the laser printer 1.

Since the interposing part 160 is located between the process cartridge 5 and the front cover 21 when the front cover 21 is closed, the contact between the process cartridge 5 and the front cover 21 is prevented. Thereby, it is possible to suppress the rattling between the process cartridge 5 and the front cover 21 during the transportation of the laser printer 1.

As illustrated in FIG. 7B, when the process cartridge 5 to which the spacing member 100 is attached is mounted to the body casing 2, the first cover part 120 is located between the coupling 76 and the driving input member 27 to cover almost the entire of the coupling 76. Accordingly, even in a case where the front cover 21 is closed, the driving input member 27 cannot be engaged with the coupling 76. Thereby, a driving force from the driving input member 27 is not transmitted to the coupling 76 (process cartridge 5).

Since the first cover part 120 thus configured is provided in this exemplary embodiment, even if a user forgets to remove the spacing member 100 in a case of using the laser printer 1, the developing roller 71 or the agitator 75 is not driven. Thereby, it is possible to prevent a stress from being applied to the toner due to the driving of the developing roller 71 or the agitator 75.

In the present exemplary embodiment, the driving input member 27 is configured to be elastically movable in the left-right direction under the action of the spring 27B. Accordingly, even if the driving input member 27 advances to engage with the coupling 76 and is brought into contact with the first cover part 120 by closing the front cover 21, the spring 27B is contracted to prevent a large force from being applied to the driving input member 27 itself or the first cover part 120 (process cartridge 5).

Further, as illustrated in FIG. 8B, when the process cartridge 5 to which the spacing member 100 is attached is mounted to the body casing 2, the second cover part 130 is located between the first electrode 25 and the wire electrode 65 and between the second electrode 26 and the grid electrode 66 to cover almost the entirety of the wire electrode 65 and the grid electrode 66. Accordingly, each pair of the electrodes 65 and 66 is not brought into contact with each other. Thereby, it is possible to suppress the wear of each electrode 65 and 66 during the transportation of the laser printer 1.

In the laser printer 1 including the process cartridge 5 to which the spacing member 100 is attached, the spacing member 100 is removed by a user when used. As the spacing member 100 is removed from the process cartridge 5, the developing roller 71 is urged to the photosensitive drum 61 by the action of the pressing member 64, as illustrated in FIG. 3. Further, since the front side of the developing unit 7 is brought into contact with the upper end of the positioning part 60B, the developing unit 7 is positioned with respect to the photosensitive unit 6 in a state of being used.

Thereafter, when the process cartridge 5 is mounted to the body casing 2 again, the driven roller 34A is brought into contact with the driving roller 34B and the driven roller 34A can be rotated in accordance with the rotation of the driving roller 34B. Further, since the wire electrode 65 is electrically connected to the first electrode 25 and the grid electrode 66 is electrically connected to the second electrode 26, it is possible to apply a bias to the process cartridge 5.

Thereafter, when the front cover 21 is closed, the driving input member 27 advances inwards in the left-right direction and is engaged with the coupling 76. Thereby, it is possible to input the driving force to the process cartridge 5, specifically, the developing roller 71 or the agitator 75.

Although the exemplary embodiment of the present invention has been described above, the present invention is not limited to the above-described exemplary embodiment. The specific configuration thereof may be suitably modified without departing from the gist of the present invention.

Although the first cover part 120 is configured to cover almost the entirety of the coupling 76 (driving input part) in the above-described exemplary embodiment, the present invention is not limited thereto. That is, the first cover part may be configured to cover at least a portion of the driving input part, as long as the first cover part is provided to suppress the engagement of the driving input part and the driving input member of the apparatus body.

Further, although the second cover part 130 is configured to cover the entirety of the wire electrode 65 and the grid electrode 66 (cartridge side electrode) in the above-described exemplary embodiment, the present invention is not limited to this. That is, the second cover part may be configured to cover at least a portion of the cartridge side electrode, as long as the second cover part is provided to suppress the contact of the cartridge side electrode and the body side electrode.

Although an electrode for applying a bias to the charger 62 is illustratively described as the cartridge side electrode and the body side electrode in the above-described exemplary embodiment, the present invention is not limited to this. For example, the cartridge side electrode and the body side electrode may be an electrode for applying a bias to the photosensitive member or the developing roller or an electrode for grounding the photosensitive member.

Although the spacing member 100 is configured by a single member in the above-described exemplary embodiment, the present invention is not limited thereto. That is, the spacing member of the present invention may be configured by multiple members. In this case, a part for preventing a rattling, for example, the interposing part 160 in the above-described exemplary embodiment may be formed by an elastic member (material).

Although the coupling 76 as an example of the driving input part is provided to the developing unit 7 in the above-described exemplary embodiment, the present invention is not limited to this. For example, the coupling may be provided to the photosensitive unit. Further, the driving input part may be respectively provided to the photosensitive unit and the developing unit.

Although the first spacing part 110, that is, a configuration for spacing the photosensitive drum 61 and the developing roller 71 is illustratively described in the above-described exemplary embodiment, the present invention is not limited to this configuration. For example, the spacing member may include a spacer which is interposed between the photosensitive member and the developing roller to space the photosensitive member and the developing roller from each other.

Although the developing unit 7 is detachably mounted to the photosensitive unit 6 in the above-described exemplary embodiment, the present invention is not limited thereto. For example, as in the process cartridge disclosed in JP-A-2007-248618, the developing unit may be swingably (displaceably) supported by the photosensitive unit to allow the developing roller to approach and separate from the photosensitive member, instead of being detachably mounted thereon.

Although the laser printer 1 for forming a monochrome image is illustratively described as an image forming apparatus in the above-described exemplary embodiment, the present invention is not limited to this. For example, the present invention may be applied to a printer for forming a color image. Further, the image forming apparatus is not limited to a printer. For example, the present invention may be applied to a copying machine or a multifunction machine including a document reading device such as a flatbed scanner.

Although the sheet S such as a plain sheet or a postcard is illustratively described as a recording sheet in the above-described exemplary embodiment, the present invention is not limited to this. For example, the present invention may also be applied to an OHP sheet.

What is claimed is:

1. An image forming apparatus comprising:

a process cartridge detachably mountable to an apparatus body, the process cartridge including:

a photosensitive unit having a photosensitive member configured to receive formation of an electrostatic latent image thereon, a developing unit having a developing roller which is configured to contact the photosensitive member to supply developer to the photosensitive member, and a driving input part configured to receive input of a driving force from the apparatus body;

the apparatus body, including:

a driving input member configured to move inwards and outwards in an axial direction of the developing roller and to input the driving force to the process cartridge when being engaged with the driving input part; and a spacing member attached to the process cartridge and configured to space the photosensitive member and the developing roller, the spacing member including:

a first cover part located between the driving input part and the driving input member and configured to cover at least a portion of the driving input part.

2. The image forming apparatus according to claim 1, wherein the developing unit is displaceably provided with respect to the photosensitive unit, and wherein the spacing member includes a maintaining part which is engaged with both the photosensitive unit and the developing unit and is configured to maintain a position of the developing unit with respect to the photosensitive unit at a predetermined position.

3. The image forming apparatus according to claim 2, wherein the photosensitive unit includes a positioning part which is configured to position the developing unit by contacting the developing unit, and wherein the maintaining part is configured to maintain the developing unit to be spaced apart from the positioning part.

4. The image forming apparatus according to claim 1, further comprising a pair of rollers configured to convey a recording sheet, wherein a first roller of the pair of rollers is supported by the process cartridge and a second roller of the pair of rollers is supported by the apparatus body, and wherein the spacing member includes a roller spacing part which is located between the first roller and the second roller and is configured to space the first roller and the second roller from each other.

5. The image forming apparatus according to claim 1, wherein the process cartridge includes a pair of bosses protruding outwardly in the axial direction, wherein the apparatus body includes a pair of guide walls configured to guide the bosses when the process cartridge is attached and detached, and wherein the spacing member includes a boss engaging part which is located between the boss and the guide wall and is engaged with the boss.

6. The image forming apparatus according to claim 1, wherein the apparatus body includes a cover configured to open and close a mounting part to which the process cartridge is mountable, and wherein the spacing member includes an interposing part which is located between the process cartridge and the cover.

7. The image forming apparatus according to claim 1, wherein the driving input member is configured to be elastically movable inwardly and outwardly in the axial direction.

8. The image forming apparatus according to claim 1, wherein the process cartridge includes a cartridge side electrode which is electrically connected to a body side electrode provided to the apparatus body and, wherein the spacing member includes a second cover part which is located between the body side electrode and the cartridge side electrode and is configured to cover at least portion of the cartridge side electrode.

* * * * *